United States Patent [19]

Sergev et al.

[11] 4,223,661

[45] Sep. 23, 1980

[54] PORTABLE DIVER HEAT GENERATING SYSTEM

[76] Inventors: Sergius S. Sergev, 210 Grandridge Ct., Ventura, Calif. 93003; Stanley A. Black, P.O. Box 322, Port Hueneme, Calif. 93041; James F. Jenkins, #268 2660 Peninsula Rd., Oxnard, Calif. 93030

[21] Appl. No.: 66,201

[22] Filed: Aug. 13, 1979

Related U.S. Application Data

[62] Division of Ser. No. 855,035, Nov. 25, 1977, abandoned.

[51] Int. Cl.[3] ..... A16F 7/06

[52] U.S. Cl. ..... 126/204; 126/263; 165/46; 128/402

[58] Field of Search ..... 126/204, 263; 128/402; 165/46; 44/3 R, 3 B; 60/218, 219

[56] References Cited

U.S. PATENT DOCUMENTS

| | | | |
|---|---|---|---|
| 3,367,319 | 2/1968 | Carter, Jr. | 126/204 |
| 3,556,205 | 1/1971 | Harwood, Jr. | 126/204 X |
| 3,583,386 | 6/1971 | Slack | 126/204 |
| 3,599,625 | 8/1971 | Curtis | 126/204 |
| 3,875,924 | 4/1975 | Bayles | 126/263 X |
| 3,884,216 | 5/1975 | McCartney | 126/263 X |
| 3,942,511 | 3/1976 | Black et al. | 126/263 |
| 4,118,082 | 10/1978 | Miyamori et al. | 126/263 |

*Primary Examiner*—Samuel Scott
*Assistant Examiner*—Randall L. Green
*Attorney, Agent, or Firm*—Richard S. Sciascia; Joseph M. St. Amand

[57] ABSTRACT

Supercorroding magnesium alloys that react rapidly and predictably with seawater to produce heat and hydrogen gas. The alloys are formed by a mechanical process that bonds magnesium and noble metal powder particles together. The alloy powders can be sintered to form barstock, etc., suitable for self-contained corroding links.

10 Claims, 14 Drawing Figures

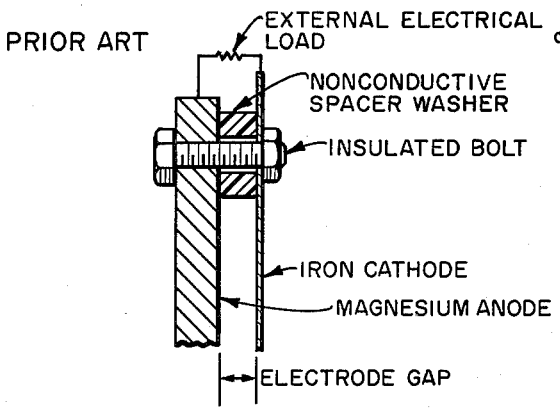
Fig. 1
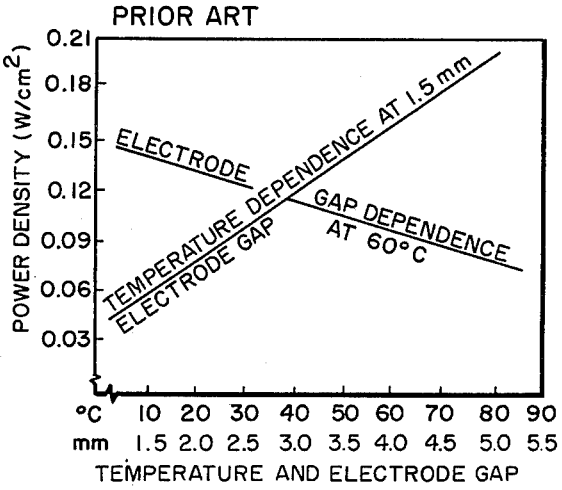
Fig. 2. EFFECTS OF TEMPERATURE AND ELECTRODE GAP ON POWER DENSITY. SOME MINIMUM GAP MUST BE MAINTAINED IN ORDER FOR REACTION PRODUCTS TO BE REMOVED FROM BETWEEN THE ELECTRODES BY ELECTROLYTE CIRCULATION.
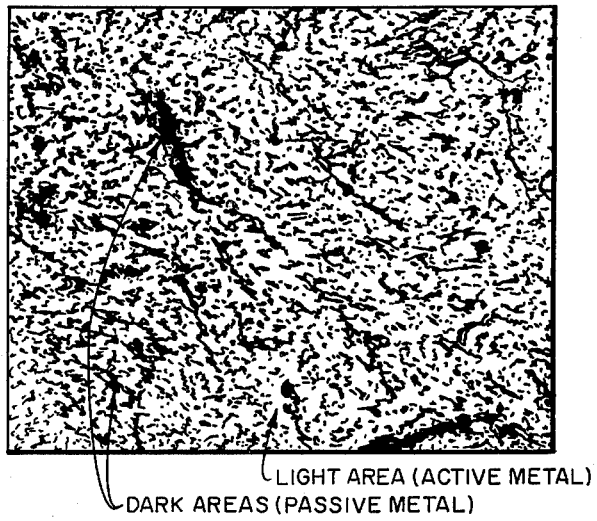
Fig. 3.
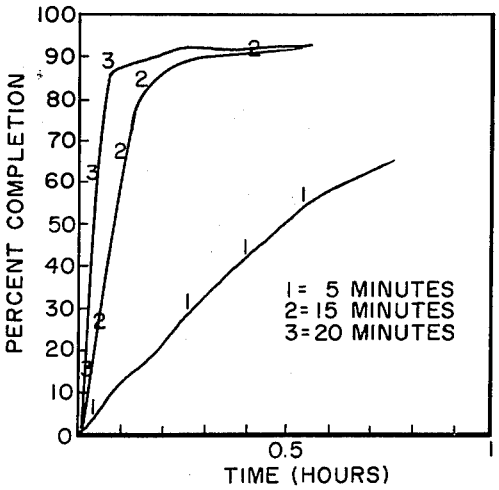
Fig. 4.
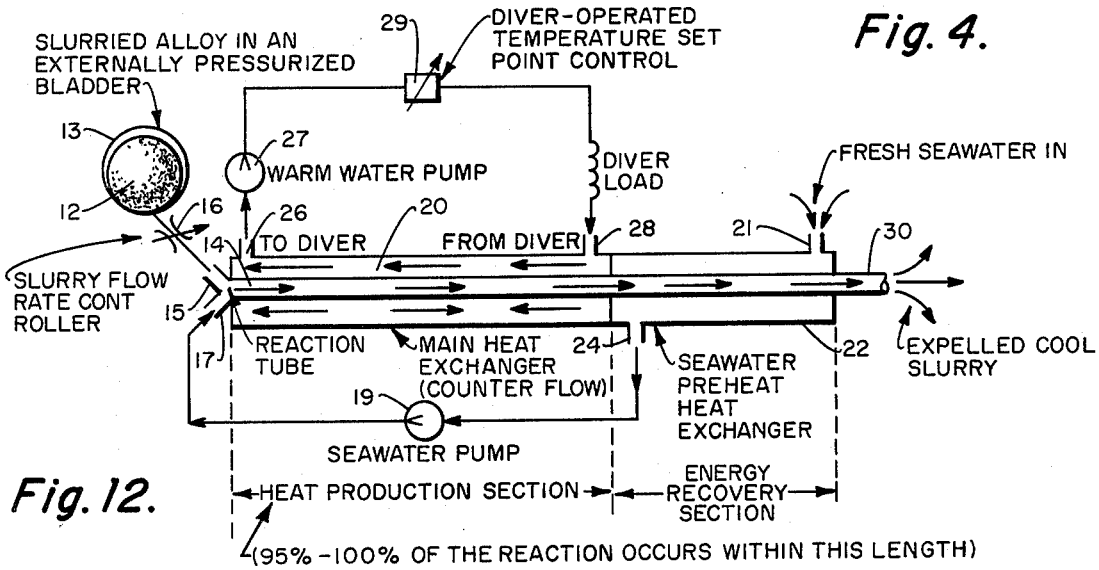
Fig. 12.

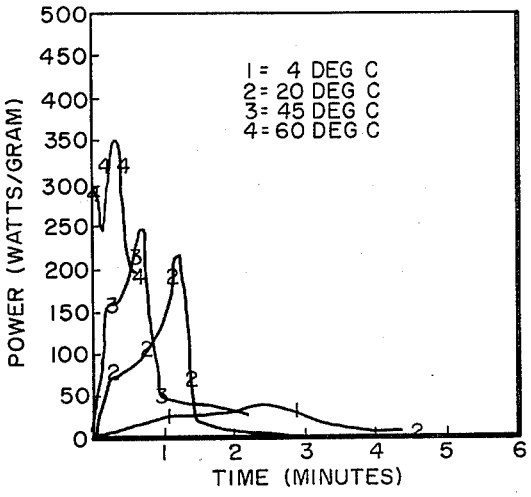
Fig. 11.
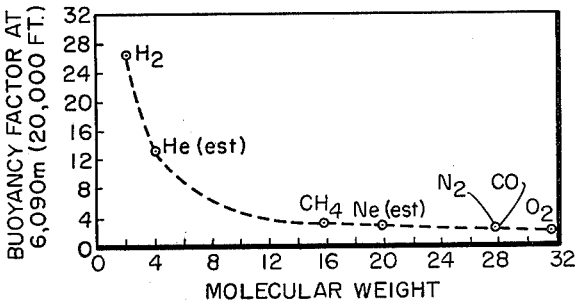
Fig. 13. BUOYANCY OF GASES AT AN OCEAN DEPTH OF 6,090m (20,000 FT.)
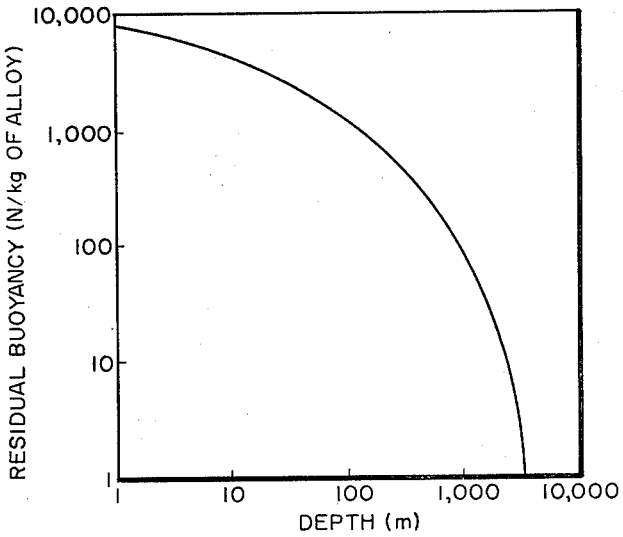
Fig. 14. RESIDUAL BUOYANCY (WEIGHT OF DISPLACED WATER-WEIGHT OF ALLOY) AS A FUNCTION OF DEPTH.

PORTABLE DIVER HEAT GENERATING SYSTEM

BACKGROUND OF THE INVENTION

This is a division of application Ser. No. 855,035, filed Nov. 25, 1977, and now abandoned.

This invention generally relates to alloys which will corrode rapidly. Such an alloy is suitable as a heat source; as a gas generator; or as a corroding release link.

Sources of heat and hydrogen gas of various types are well known in the art, especially by virtue of earlier already issued United States Patents commonly assigned herewith such as: U.S. Pat. No. 3,884,216 issued May 20, 1975 for ELECTROCHEMICAL ENERGY SOURCE FOR DIVER SUIT HEATING; U.S. Pat. No. 3,942,511 issued Mar. 9, 1976 for SANDWICHED STRUCTURE FOR PRODUCTION OF HEAT AND HYDROGEN GAS; U.S. Pat. No. 3,993,577 issued Nov. 23, 1976 for METHOD FOR PRODUCTION OF HEAT AND HYDROGEN GAS; and, U.S. Pat. No. 4,017,414 issued Apr. 12, 1977 for POWDERED METAL SOURCE FOR PRODUCTION OF HEAT AND HYDROGEN GAS.

At least two methods have been employed in the past to achieve high corrosion rates. One is to construct a short circuited battery-like cell of noble and active plates separated by an electrode gap such as disclosed in aforementioned U.S. Pat. No. 3,884,216. Another method is to form a powder by mechanically joining the discrete particles of noble and active powders such as disclosed in aforementioned U.S. Pat. Nos. 3,942,511, 3,993,577 and 4,017,414 where each powder particle is a small galvanic cell.

The battery-like cell has two principal disadvantages: the power output is dependent upon the electrode gap (internal cell resistance) and the resistance in the electrical short circuits (external load) limits the reaction rate. In order to maximize power output, the electrode gap must approach zero. Yet, to sustain the reaction, reaction products must be flushed away from the reacting surfaces. This requires a small initial gap between the plates. The gap creates high internal cell resistance which reduces the power obtainable from the cell. A further decline in power occurs because of the gap increase as the active plate is consumed.

The resistance in the electrical short circuit between the noble and active materials can limit power output. To maximize output, the external short circuit resistance must be minimized. In the battery like configuration the resistance is kept low by providing several relatively shortlength paths between the plates. Low resistance spacers are used to maintain the electrode gap. Thus, the electrical resistance is minimized within the configuration and material limits.

In the powdered form where each grain of powder is a small galvanic cell similar to the larger battery-like cell, noble metal particles mechanically joined to the surface of an active metal particle, as disclosed in aforementioned U.S. Pat. No. 4,017,414. The combination retains the property and identity of each constituent. But each cell will react with itself, so no electrode gap is necessary or exists. The short circuit path length is minimized because the particles are in direct contact. However, the short circuit resistance is not necessarily minimized. Electrical resistance between individual particles is a function both of physical proximity and of the oxides that exist on the metal particle surfaces (this is also true for the battery-like configuration). Because high resistance surface oxides are present, excellent mechanical contact may not assure intimate electrical contact. Due to the random method of joining the particles, some metal particles may not be paired into micro-cells but may remain free and will not react at all. In this prior art, powder form the internal cell resistance may be minimized but the external or load resistance may be high.

SUMMARY

The supercorroding alloy (of this invention) is formed from a noble metal and an active metal, or more than two constituents can be used. The metals can be the same as used in the battery-like or powder configurations, or other metals may be used. In any case, the constituents are chosen based on their ability to form an alloy which will corrode at a predictable rate in the available electrolyte. In particular, an alloy that will react in seawater can be made using magnesium and a noble metal such as iron or nickel. Any of the usual methods can be employed in producing the alloy: conventional dissolution, mechanical alloying, etc. The proportions, particle size, and the homogeneity are selected to control the reaction rate. A maximum reaction rate can be achieved at some particular mixture proportions. The resulting alloy is used in either plate, bar or powder form. The plate and powder forms are especially suited for use as a heat source or a gas generator. A corroding release link can be fabricated from barstock. The supercorroding alloys are superior to previous similar methods for producing heat and gas.

Often alloys are formed to resist corrosion. However, the alloy of this invention is specifically intended for use as a rapidly corroding alloy. By alloying the desired metal constituents, the two main disadvantages of previous methods of producing high corrosion rates are eliminated. The alloy can have properties different from either of the constituents. Since the alloy is a uniform mixture of the metals in intimate contact with each other, there is no electrode gap to maintain so internal cell resistance is minimized and the electrical short circuit resistance will be substantially a function only of the path length between the centers of the reacting masses.

Since no electrode gap exists, the power output of a heat source constructed of the alloy in plate form in the short-circuited battery configuration will not decline as the space between the plates increases due to material consumption. A fluid circulation space will still have to exist, however, to flush away reaction products. Electrical resistance is the minimum attainable due to the extremely short current path lengths and because of the intimate contact and strong mechanical bond.

In the powdered form of the alloy all of the metal particles are coupled into micro-cells because of the completely uniform mixture of the alloy constituents. Again, the electrical contact is the optimum attainable.

This super corroding alloy has the additional feature of being suitable for use as corroding barstock. In this form, corroding links can be made for use either as primary or backup releases for oceanographic instruments. By adjusting the alloy composition, the reaction rates, thus the release times, can be controlled.

BRIEF DESCRIPTION OF THE DRAWINGS

FIG. 1 shows a typical dual plate (prior art type) battery cell.

FIG. 2 shows the effects of temperature and electrode gap on power density, for a cell such as in FIG. 1.

FIG. 3 is an enlarged cross sectional view of a small mechanically alloyed magnesium particle of this invention having smaller particles of iron dispersed throughout the magnesium matrix.

FIG. 4 are curves showing the effect of high energy milling time on reaction rate for magnesium based mechanical alloys of this invention.

FIG. 11 are typical power curves for the FIG. 11 alloy as a function of temperature.

FIG. 12 is a diagrammatic illustration of an arrangement for a diver heater system utilizing supercorroding alloys of this invention as a heat source.

FIG. 13 shows the buoyancy of gases at an ocean depth of 6,090 meters.

FIG. 14 is a curve showing residual buoyancy as a function of depth.

DESCRIPTION OF PREFERRED EMBODIMENT

Figure 5:
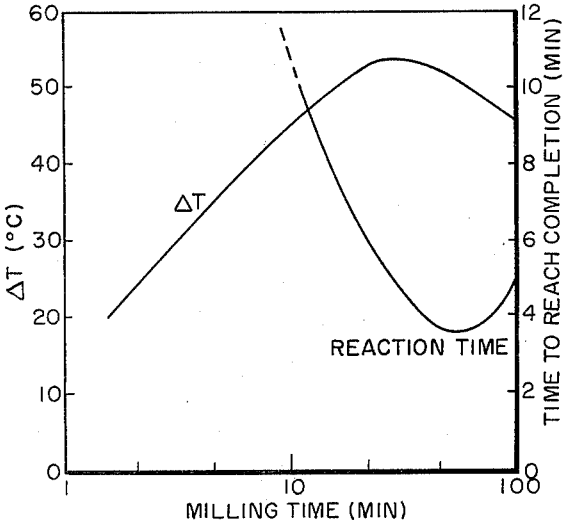
FIG. 5 shows the effect of prolonged milling on the reaction rate for the mechanically alloyed magnesium-based alloys.

A family of supercorroding magnesium alloys have been developed that react spontaneously and vigorously with seawater to produce heat and hydrogen gas. The alloys have been developed as a self-contained heat source for Navy diver use, but they may also be used to generate hydrogen gas for buoyancy, thermodynamic engines, and fuel cells. Because of their uniform and predictable behavior, the alloys can be used as corroding links to retrieve oceanographic equipment.

Various cathodic materials in different proportions have been alloyed with magnesium. Tests were conducted to determine how the reaction is affected by alloy composition and constituent proportions, temperature, and pressure.

In general, magnesium reacts with seawater according to the formula:

$$Mg + 2H_2O \rightarrow Mg(OH)_2 + H_2 + heat$$

The reaction has a theoretical energy density of 14,929 kJ/kg (1885 W-h/lb) and produces 0.921 liter of gas per gran of magnesium (14.8 $ft^3$/lb) at STP. By itself, magnesium corrodes slowly in seawater because of low, local potential differences within the magnesium. When a suitable cathodic material is brought into close proximity and electrically connected with the magnesium, a battery is formed, and the corrosion reaction proceeds rapidly. The dual-plate cell shown in FIG. 1 represents this configuration. With the electrical load replaced by a short circuit, the reaction proceeds even more rapidly, and the cell efficiently produces heat and hydrogen gas. The rate of reaction is known to be a function of (1) electrolyte temperature, pH, salinity, and density, (2) anode-cathode plate spacing, and (3) ambient pressure. The effects of temperature and spacing on dual-plate cell performance are shown in FIG. 2. Some minimum gap must be maintained in order for reaction products to be removed from between the electrodes by electrolyte circulation.

A diver heater, based on the short-circuited dual-plate cell, was built and tested. The cell consisted of alternate magnesium and iron plates spaced apart by copper washers that provided the short circuit. One of the main drawbacks to this construction is that as magnesium is consumed, the electrode gap increases and power output declines.

To eliminate this decline and to achieve faster reaction rates, powdered metal mini-cells were conceived as discussed in aforementioned U.S. Pat. No. 4,017,414. The mini-cells were fabricated by ball-milling, a mixture of iron and magnesium powders (using lightweight ceramic balls). The milling produced composite particles by mechanically bonding the constituents together.

Later tests showed that accelerated reaction rates were achieved using the mini-cells, but that the reaction efficiency (percentage completion) was much lower than predicted. The optimum rate occurred between 5 and 10 percent iron content. The accelerated reaction rate was attributed to the close proximity of the anode-cathodic pairs and the relatively large cathode surface area. The low efficiency was attributed to poor electrical contact and low mechanical strength of the Mg-Fe bond.

Supercorroding Alloy Formation

An alloying process called mechanical alloying has been used to overcome the problems that limited the mini-cells efficiency. Mechanical alloying involves a high energy ball mill and does not used an inert solvent with the powdered metal particles as disclosed in aforementioned U.S. Pat. No. 4,017,414. The active and passive metal particles are processed (i.e., mechanically alloyed) dry.

Alloys have been fabricated with as much as 20 percent iron content using mechanical alloying techniques. Tests have shown that magnesium-based alloys react several orders of magnitude faster than the previous mini-cells. Because of their extremely high corrosion rate, these materials were named supercorroding alloys.

Mechanical alloys are produced in a high-energy ball mill by repeated flattening, fracturing, and welding of the metal constituents (i.e., active and passive metal particles). The energy of the impact of colliding steel balls, with particles trapped between them, creates atomically clean particle surfaces. When these clean surfaces come in contact during collisions, they cold-weld together. An inert atmosphere in the mill prevents reoxidation of the clean surfaces.

The tendency of powdered particles to cold-weld together predominates during the early stage of the process. As milling continues, particles get harder and more brittle, and eventually a balance results between welding and particle fracturing. Continued milling refines the particles' characteristic layered structure. The thickness of each layer in the composite particle decreases from repeated impacts.

The resulting mechanically alloyed powders are particles (i.e., matrices) of active metal having smaller particles of passive metals dispersed throughout. FIG. 3 shows a cross-section of a portion of an active metal particle (e.g., magnesium) having many smaller passive metal particles (e.g., iron) dispersed within the active metal matrix. The active metal particle is shown as white and the smaller passive metal particles shown as black. Many of the passive metal particles are shown as elongated having been flattened in the milling process; the longest dimension of the active iron particles is about 30 microns. As is discussed below, the preferred powdered alloy particle size is between 80 and 100 mesh. The intimate (atomic level) contact between the alloy constituents is the key to rapid corrosion rate.

Alloy performance was evaluated by recording gas evolution as a function of time; this was used to determine reaction completion (energy output) and reaction rate (power).

Percentage reaction completion at a particular time is calculated from the ratio of the volume of gas produced at that time to the maximum theoretical gas production. Power is calculated essentially from the slope of the percent-completion-versus-time curve. Maximum gas production is calculated from the basic reaction equation using the actual amount of magnesium in a given weight of alloy.

A series of experiments was conducted to select an optimum milling time and particle size for further tests. Maximum reaction rate and reaction efficiency were used as a basis of evaluation. Visual observation of the reaction revealed that particles that passed through a 100-mesh sieve would not stay submerged in the seawater, but instead would float on the surface and form a foam. This resulted in reduced reaction rates. It was later observed that particles larger than 100 mesh would cycle from the bottom of the flask to the seawater surface and then sink. The cycling was caused by the formation of a hydrogen bubble which buoyed the particle. The hydrogen bubble was shed at the surface, and the particle sank. As a result, particles that would not pass through a 100-mesh sieve were used in subsequent tests. The estimated particle size is between 80 and 100 mesh.

As previously discussed, continued milling refines the layered structure. To determine the effect of this refinement on the reaction rate, magnesium-based alloys of 5 atomic percent iron were milled for 5, 15, and 30 minutes each and tested. The effect of the milling time on the reaction rate shows that the longer the powders are milled, the more homogeneous they become, and the more homogeneous powders react most rapidly. Percent completion is shown in FIG. 4. The alloy milled for 30 minutes reached the highest percent completion in the least time. (The test of the alloy milled for 5 minutes was terminated prior to reaching completion, but, clearly, it reacts much more slowly.)

Additional alloys were fabricated and tested to determine the effect of further milling on reaction rate. The maximum temperature rise of the water and time to completion were recorded. FIG. 5 shows, in a general way, the effect of milling time on the reaction. An optimum milling time occurs when the time to reach a maximum $\Delta T$ is the least. Again, alloys milled for 30 minutes showed the highest temperature rise in the least amount of time. Based on these results, the remaining alloys were prepared under conditions similar to the 30-minute alloy.

Figure 6:
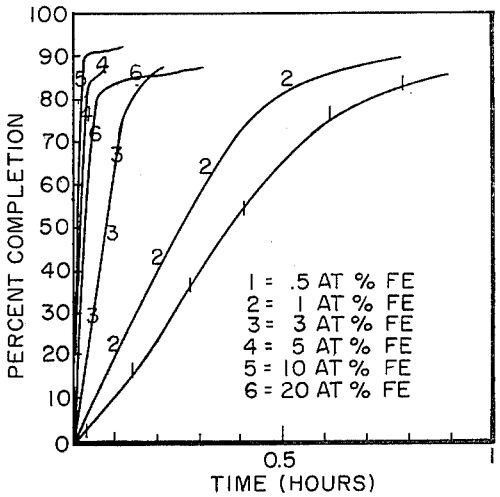
FIG. 6 are percent completion time curves for a family of magnesium-iron mechanical alloys.

Magnesium alloys with different percentages of iron were prepared and tested; the results are plotted in FIG. 6. (Up to 10 percent iron, reaction rate increases with increasing iron content. Up to about 10 percent iron, the reaction is evidently limited by the amount of cathode present. Beyond 10 percent, the iron begins to mask active areas of the magnesium, reducing the reaction rate.) They show that the reaction rate depends strongly upon cathode content up to approximately 10 atomic percent. However, several tests of the alloy with 20 percent iron showed a significant decrease in the reaction rate. This phenomenon is believed to be caused by the reduction of exposed anode surface area due to the increased cathode content.

Cathodic percent does not appear to strongly affect the level of reaction completion. Thus, a particular alloy can be selected on the basis of reaction rate or on the basis of energy density. A summary of energy density and other characteristics of alloys tested is shown in Table I. The table shows that energy density (kJ/kg of alloy) decreases with increasing cathode content, while peak power increases.

TABLE I

Characteristics of Various Alloys

| Alloy* | Cathode content (% by weight) | Energy Density (kJ/kg) | Peak Power (W/gm) | Average Power** (W/gm) |
|---|---|---|---|---|
| 5 minutes | 10.8 (Fe) | 13,349 | 4 | 3.7 |
| 15 minutes | 10.8 (Fe) | 13,349 | 28 | 26.1 |
| 30 minutes | 10.8 (Fe) | 13,349 | 83 | 60.9 |
| 0.5 (Fe) | 1.1 | 14,793 | 6 | 5.6 |
| 1 (Fe) | 2.3 | 14,619 | 8 | 8 |
| 3 (Fe) | 6.6 | 13,968 | 31 | 20 |
| 5 (Fe) | 10.8 | 13,349 | 220 | 69 |
| 10 (Fe) | 20.3 | 11,921 | 279 | 114 |
| 20 (Fe) | 36.5 | 9,500 | 76 | 51 |
| 1 (Cu) | 2.6 | 14,580 | 6 | 2.9 |
| 3 (Cu) | 7.5 | 13,841 | 14 | 6.4 |
| 5 (Cu) | 12.1 | 13,151 | 22 | 10.7 |
| 10 (Cu) | 22.5 | 11,595 | 35 | 18.7 |
| 5 (Ti) | 9.4 | 13,556 | 2 | 1.5 |
| 5 (Cr) | 10.1 | 13,445 | 4 | 3.8 |
| 5 (C) | 2.5 | 14,580 | 9 | 4.4 |
| 5 (Ni) | 11.3 | 13,278 | 163 | 100 |

*Identified by cathodic atomic percent or milling time
**Average power - energy liberated at t - (time to peak power) × 2 divided by t.

Stored strain energy from the milling process was thought to have an effect on the reaction. To test this idea, pure magnesium was milled and reacted. There was no significant difference between the reaction of milled and unmilled magnesium powders. Thus, the conclusion was reached that strain energy does not appreciably affect the reaction rate.

Figure 7:
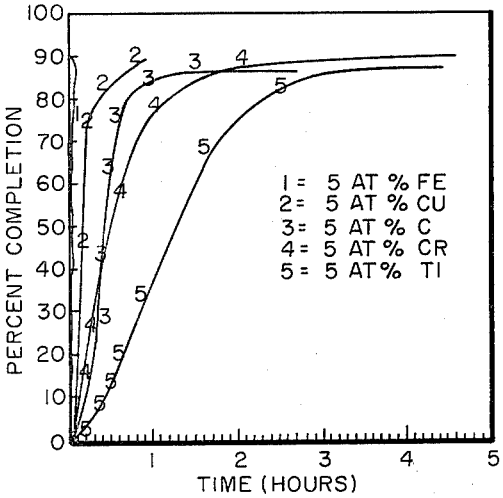
FIG. 7 shows the effect of cathode material on reaction rate for various mechanical alloys.

A small number of other alloys have been produced and evaluated. Some were magnesium based with a variety of cathodic materials; others were aluminum and zinc based. A family of percent completion curves for magnesium based alloys with 5 atomic percent Cu, C, Cr, and Ti is shown in FIG. 7. (For a fixed cathode proportion, reaction rate is dependent on cathode material.) An alloy of 5 atomic percent nickel was tested and found to react similarly to the 5 percent iron. Energy and power densities also are summarized in Table I. The mechanical alloy composition can be varied to adjust the corrosion rate.

The results of tests clearly show that iron and nickel are the most reactive of the cathode materials tested. Table I shows that 5 percent carbon has a slightly higher energy density than iron, but its power output is much lower.

Figure 8:
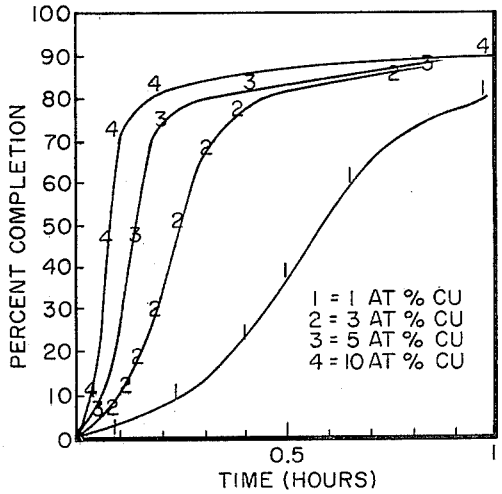
FIG. 8 are percent completion curves for various magnesium-copper mechanical alloys.
Figure 9:
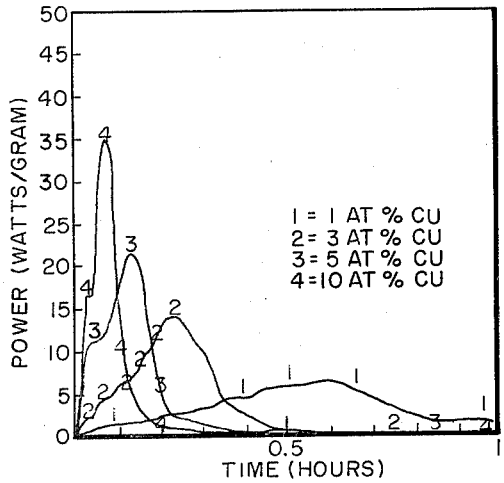
FIG. 9 shows power curves for magnesium-copper alloys.

To verify the dependence of the reaction process on cathode content (shown by the magnesium-iron alloys) a series of tests on magnesium-copper alloys was conducted. The results of the copper family tests are shown in FIGS. 8 and 9. (The time to reach a given percent completion varies approximately inversely with the amount of copper in the alloy. The effect of copper content is dramatically illustrated as doubled copper content results in approximately doubled peak power outputs, i.e., reaction rates.) FIG. 8 shows that the time to reach 50 percent completion is reduced by about half as the amount of copper is doubled. This geometric relationship is dramatically illustrated by the power curves of FIG. 9; peak power is approximately doubled as copper content is doubled.

Other alloys based on zinc and aluminum in place of magnesium have been fabricated and tested. The cathode materials were iron and copper. In seawater, none of these alloys showed a reactivity as great as the unalloyed base magnesium powder, so they have not been pursued further.

Figure 10:
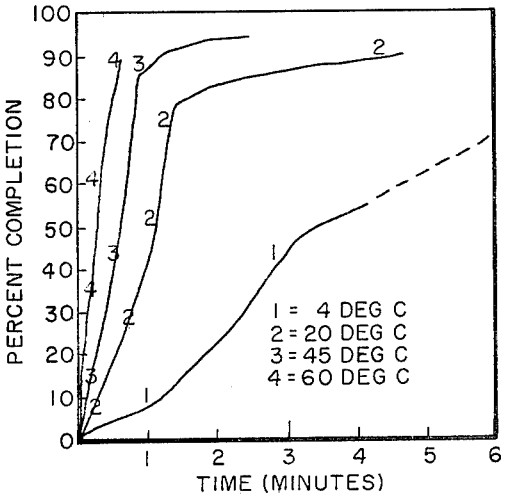
FIG. 10 shows typical percent completion curves for a particular alloy as a function of temperature.

Tests were conducted to determine the effect of electrolyte temperature and ambient pressure on the reaction. For the temperature tests the seawater was preheated (or cooled) to the desired temperature before adding it to the alloy. The test results, plotted in FIGS. 10 and 11, show the reaction to be a strong function of the electrolyte temperature. Increasing the temperature increases the reaction rate. Peak power is strongly related to reaction temperature. Attempts were made to use starting temperatures above 60° C.; however, the reaction is so rapid that the bath could not maintain a constant temperature, and the seawater invariably boiled.

Supercorroding alloys were conceived as heat sources for use by divers. In this application it is essential to provide both rapid generation of heat and high reaction efficiencies. The magnesium-iron alloys appear to be well suited for this task.

One configuration for a fuel-type heater using supercorroding alloys of this invention is shown in FIG. 12. In this system the powdered mechanical alloy 12 is slurried with inert ingredients which do not react with the components but which facilitate pumping the reactants to the electrolyte. An externally pressurized bladder 13, for example, (or other suitable slurry feed device) can be used to pump the slurried alloy 12 into open-ended reaction tube 14 at 15 via a slurry flow rate controller 16. Approximately equal volumes of seawater and slurry are injected into reaction tube 14. Seawater is injected into tube 14 at 17 by means of seawater pump 19. The heat produced by the reaction of the powdered alloy with seawater is removed by the counterflow fluid in main heat exchanger tube 20 (i.e., heat production section) that surrounds tube 14. Fresh incoming seawater at inlet 21 is preheated in the seawater preheat heat exchanger 22 (i.e., energy recovery section) which is separated from main heat exchanger 20 by a partition. Reaction tube 14 passes through both heat exchanger sections 20 and 22. Cooled slurry is expelled at the opposite end as shown in the drawing. Fresh water is preheated by the expelled reactants and products in order to conserve energy. Preheated seawater is then pumped out from heat exchanger 22 at 24 and injected at inlet 17 into reaction tube 14. The rates at which the slurry and seawater are injected into reaction tube 14 can be varied to control the amount of heat generation. Water in main heat exchanger 20 which surrounds reaction tube 14 is heated by transfer of heat generated from the reaction of seawater with the slurried alloy. The heated fluid (e.g., water) is then circulated via outlet 26 through a water circulation garment worn by the diver (e.g., diver load) by means of warm water pump 27. Water from the diver's suit is then returned to the main heat exchanger 20 via inlet 28 for reheating. Control of heat in the diver's suit (i.e., rate of warm water circulation flow, etc.) is by means of a diver-operated temperature set point control 29, for example.

A typical inert slurry mixture to facilitate the addition of the mechanical alloyed reactants to the electrolyte in a reaction chamber by pumping the inert slurry containing the powdered alloy through feed lines, for example, is given below:

| Constituent | Proportion (by weight) | |
|---|---|---|
| Supercorroding alloy powder | up to | 447.0 |
| Methoxy polyethylene glycol | | 394.0 |
| N-oco beta amino butyric acid | | 3.0 |
| Colloidal silica | at least | 19.7 |
| Diethylenetriamine | | 1.0 |

A preferred embodiment of the foregoing slurry was a completely inert gel like slurry containing in proportion by weight: magnesium-iron powder 447.0, methoxy polyethylene glycol 394.0, N-oco beta amino butyric acid 3.0, colloidal silica 19.7, diethylenetriamine 1.0.

In slurry form, the powdered supercorroding reactants can be supplied to an electrolyte on a demand basis. By varying the slurry addition rate to a reaction chamber, power can be controlled.

A second application for the supercorroding alloys is to produce hydrogen. Hydrogen can be used in either ocean buoyancy applications or for powering hydrogen-type fuel cells which produce electrical energy. Hydrogen is especially suited for buoyancy applications because of its low molecular weight. A comparison of the molecular weights and buoyancy factor (pounds of water displaced/pound of gas) is shown in FIG. 13. One kilogram (2.2 lbs) of 5 atomic percent magnesium-iron alloy is capable of producing 800 liters (28 $ft^3$) of hydrogen at STP in less than 5 minutes. The residual lift capability (weight of seawater displaced minus the weight of the fuel) of this alloy is shown in FIG. 14.

There are many ways that supercorroding alloys can be used to produce hydrogen. If a totally controlled production rate is desired, a slurry metering system similar to the diver heater application could be used. For small buoyancy generators (less than 4500 N (1000 lbs)), gas could be generated by rupturing a plastic pouch containing the alloys. The pouch would be located below the container that collects the gas; this container would be attached to the object to be lifted.

Another application for the supercorroding alloys is in the construction of sintered self-destructing corroding links. The alloy powders can be sintered to form barstock, etc., suitable for making self-contained corroding links. In many ocean engineering applications a timed release device is needed to shed temporary hydro-dynamic drag reduction shrouds or to aid in recovering instrumentation. A variety of devices is presently used. Most of the devices are either not totally reliable or are extremely expensive. Presently used corroding links require two separate parts (anode and cathode) that must be electrically connected to promote the link destruction. The electrical connections to the parts are often unreliable and break down. Since the supercorroding alloys are inherently self-destructing, the need for electrical connections is removed. Release times can be controlled either by sizing the dimensions of the supercorroding alloy or by selecting the alloy composition. Either way, a variety of corroding links that last for periods of minutes to hours can readily be manufactured using the present supercorroding alloys.

Supercorroding alloys have advantages over prior type fixed-plate cells and mini-cells in diver heating applications. They are at least an order of magnitude more reactive than either the fixed-plate cell or the mini-cells. They are independent of external electrical resistance and internal electrical resistance is minimal. Reaction rates can be selected by choosing the composition of the alloy. The output or hydrogen produced can be varied by controlling either the reaction temperature or the metering rate of the alloy to a reaction chamber.

By forming a wide variety of alloys, a range of reaction rates can be obtained. Alloys can be chosen for use by matching their reaction rates to the application: high rates are suitable for heat and gas generation; low, steady, predictable rates are suited to corroding links.

Obviously many modifications and variations of the present invention are possible in the light of the above teachings. It is therefore to be understood that within the scope of the appended claims the invention may be practiced otherwise than as specifically described.

What is claimed is:

1. A portable heat generating system, suitable for use with a diver water circulation garment, comprising:

a. a reaction chamber having an inlet and an outlet;

b. a heat exchanger chamber separate from and surrounding said reaction chamber;

c. said heat exchanger chamber having separate first and second sections;

d. the first section of said heat exchanger chamber having an inlet and outlet thereto through which a heating fluid is circulated;

e. a source of supercorroding mechanically alloyed powder;

f. means for supplying a controlled amount of said supercorroding alloy powder from said source to the inlet of said reaction chamber;

g. the second section of said heat exchanger chamber having an inlet and an outlet through which fresh seawater is circulated for preheating;

h. means for supplying a controlled amount of preheated seawater from the second section of said heat exchanger to the inlet of said reaction chamber where said seawater is mixed with said supercorroding powder for reaction thereof and high generation of heat; the heat generated being substantially removed by the heating fluid and seawater circulated through said first and second chambers, respectively, of said heat exchanger chamber;

i. the cooled byproducts from the reaction of the seawater and supercorroding alloy powder being expelled from said reaction chamber outlet along with hydrogen.

2. A heat generating system as in claim 1 wherein the inlet and outlet from the first section of said heat exchanger chamber is connected to a heating load via circulation means; the heating fluid being heated in said heat exchanger and circulated through said heating load by said circulation means.

3. A heat generating system as in claim 2 wherein means is provided to control the temperature to said heating load.

4. A heat generating system as in claim 1 wherein said supercorroding alloy powder is supplied from said source mixed with inert ingredients as a slurry.

5. A heat generating system as in claim 4 wherein said means for supplying said supercorroding alloy powder from said source is an externally pressurized bladder and a slurry flowrate controller.

6. A heat generating system as in claim 4 wherein said slurry is inert and of gel type consistency which facilitates pumping thereof.

7. A heat generating system as in claim 4 wherein said slurry consists in proportion by weight of: magnesium based mechanically alloyed powder 447.0, methoxy polyethylene glycol 394.0, N-oco beta amino butyric acid 3.0, collodial silica at least 19.7, diethylenetriamine 1.0.

8. A heat generating system as in claim 1 wherein a seawater pump is provided to circulate water through said second section of the heat exchanger and into said reaction chamber.

9. A heat generating system as in claim 1 wherein said heating fluid through the first section of said heat exchanger counter flows the direction of flow of reactants through said reaction chamber.

10. A heat generating system as in claim 1 wherein 95 percent or more of the heat of reaction is produced in the portion of said reaction chamber which is surrounded by the first section of said heat exchanger, the balance of heat produced substantially occurring within the portion of said reaction chamber which is surrounded by the second section of said heat exchanger.

* * * * *

UNITED STATES PATENT AND TRADEMARK OFFICE

CERTIFICATE OF CORRECTION

PATENT NO. : 4,223,661

DATED : 23 September 1980

INVENTOR(S) : Sergius S. Sergev et al

It is certified that error appears in the above-identified patent and that said Letters Patent are hereby corrected as shown below:

[73] Assignee: The United States of America as represented by the Secretary of the Navy, Washington, D. C.

Signed and Sealed this

*Ninth* Day of *December 1980*

[SEAL]

*Attest:*

SIDNEY A. DIAMOND

*Attesting Officer*

*Commissioner of Patents and Trademarks*